US010451081B2

(12) United States Patent
Isomura et al.

(10) Patent No.: US 10,451,081 B2
(45) Date of Patent: Oct. 22, 2019

(54) TURBOFAN AND AIR-CONDITIONING APPARATUS

(71) Applicant: Mitsubishi Electric Corporation, Tokyo (JP)

(72) Inventors: Kazuki Isomura, Tokyo (JP); Makoto Kurihara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 227 days.

(21) Appl. No.: 15/547,234

(22) PCT Filed: Apr. 20, 2015

(86) PCT No.: PCT/JP2015/062004
§ 371 (c)(1),
(2) Date: Jul. 28, 2017

(87) PCT Pub. No.: WO2016/170577
PCT Pub. Date: Oct. 27, 2016

(65) Prior Publication Data
US 2018/0038379 A1 Feb. 8, 2018

(51) Int. Cl.
*F04D 29/30* (2006.01)
*F04D 29/22* (2006.01)
(Continued)

(52) U.S. Cl.
CPC ..... *F04D 29/2222* (2013.01); *F04D 17/08* (2013.01); *F04D 29/2216* (2013.01);
(Continued)

(58) Field of Classification Search
CPC ..... F04D 29/282; F04D 29/30; F04D 29/661; F05D 2240/305; F05D 2260/96
See application file for complete search history.

(56) References Cited

U.S. PATENT DOCUMENTS 3,426,965 A * 2/1969 Kulling ..... F04D 29/282 415/98
6,368,062 B1 * 4/2002 Yagami ..... F04D 29/282 416/178
(Continued)

FOREIGN PATENT DOCUMENTS

EP 1878923 A2 1/2008
JP S64-041696 U 3/1989
(Continued)

OTHER PUBLICATIONS

International Search Report of the International Searching Authority dated Jul. 28, 2015 for the corresponding International application No. PCT/JP2015/062004 (and English translation).
(Continued)

*Primary Examiner* — Ninh H. Nguyen
(74) *Attorney, Agent, or Firm* — Posz Law Group, PLC

(57) ABSTRACT

Provided is a turbofan producing reduced noise and easily manufactured. A coupling portion between a blade main portion and a blade cover is formed in a surface region (pressure surface) parallel to a direction of air flowing over the pressure surface of each blade. With this configuration, the air sucked from a direction of a rotation axis of a turbofan is less liable to enter a gap of the coupling portion of the blade, thereby being capable of reducing noise. Further, noise is reduced so that high-precision dimensional control of the gap of the coupling portion of the blade is not required. Consequently, dimensional control at the time of manufacture is facilitated to thereby facilitate manufacture.

5 Claims, 4 Drawing Sheets

(51) Int. Cl.

| | |
|---|---|
| ***F04D 29/28*** | (2006.01) |
| ***F04D 17/08*** | (2006.01) |
| ***F04D 29/66*** | (2006.01) |

(52) U.S. Cl.

CPC ..... *F04D 29/282* (2013.01); *F04D 29/30* (2013.01); *F04D 29/66* (2013.01); *F05D 2240/305* (2013.01)

(56) References Cited

U.S. PATENT DOCUMENTS

| | | | | |
|---|---|---|---|---|
| 8,007,240 | B2 * | 8/2011 | Sanagi | F04D 29/282 29/889.4 |
| 8,365,542 | B2 * | 2/2013 | Shah | F24F 3/153 62/151 |
| 9,528,374 | B2 * | 12/2016 | Ikeda | F04D 29/281 |
| 9,810,234 | B2 * | 11/2017 | Bahren | F04D 29/283 |
| 2007/0098556 | A1 | 5/2007 | Sanagi et al. | |

FOREIGN PATENT DOCUMENTS

| | | | |
|---|---|---|---|
| JP | S64-041697 | U | 3/1989 |
| JP | 2005-155510 | A | 6/2005 |
| WO | 2005/052377 | A1 | 6/2005 |

OTHER PUBLICATIONS

Extended European Search Report dated Jan. 30, 2017 in the corresponding EP patent application No. 15871292.7.

Office Action dated Feb. 11, 2018 issued in corresponding CN patent application No. 201610144152.8 (and English translation).

Office action dated Jul. 24, 2018 issued in corresponding JP patent application No. 2017-513847 (and English translation thereof).

* cited by examiner

TURBOFAN AND AIR-CONDITIONING APPARATUS

This application is a U.S. national stage application of PCT/JP2015/062004 filed on Apr. 20, 2015, the contents of which are incorporated herein by reference.

TECHNICAL FIELD

The present invention relates to a turbofan and an air-conditioning apparatus, and more particularly, to a technology for preventing air from flowing into a gap of a coupling portion in which two components forming surfaces of a blade are coupled to cause noise.

BACKGROUND ART

In a related-art turbofan, a plurality of hollow blades are each constructed by a first surface portion and a second surface portion mounted to the first surface portion. Thus, even when each of the hollow blades has a shape extending axially between a main plate and a side plate in a twisting manner (that is, forms a three-dimensional blade), formation of a hollow space in the blade is promoted, thereby reducing a weight of an impeller (see, for example, Patent Literature 1).

CITATION LIST

Patent Literature

Patent Literature 1: Japanese Unexamined Patent Application Publication No. 2005-155510

SUMMARY OF INVENTION

Technical Problem

To reduce a weight by forming a hollow space in each blade, in the related-art turbofan including blades (three-dimensional blades) extending axially in a twisting manner, two components forming surfaces of each blade are coupled to each other, to thereby construct the blade.

However, when a coupling portion coupling the two components to each other has a large gap in a region positioned at a shroud-side leading edge portion of the blade, air flows into the gap, thereby increasing noise. For this reason, there is a problem in that high-precision dimensional control of the gap of the coupling portion is required at the time of manufacture.

The present invention has been made to solve the above-mentioned problem, and has an object to provide a turbofan and an air-conditioning apparatus producing reduced noise and easily manufactured.

Solution to Problem

A turbofan according to the present invention includes a main plate having a circular shape and being configured to be rotationally driven, a shroud having an annular shape and being arranged to be opposed to the main plate, and a plurality of hollow blades arranged between the main plate and the shroud, each of the plurality of hollow blades including a blade main portion arranged to be spaced apart from another blade main portion in a circumferential direction of the main plate, and a blade cover mounted to the blade main portion to define a hollow space between the blade main portion and the blade cover, a coupling portion between the blade main portion and the blade cover being formed in a surface region parallel to a direction of air flowing over a pressure surface of each of the plurality of hollow blades.

Advantageous Effects of Invention

In the turbofan according to the present invention, the coupling portion between the blade main portion and the blade cover is formed in the surface region parallel to the direction of the air flowing over the pressure surface of each of the hollow blades. Thus, the air sucked from a direction of a rotation axis of the turbofan is less liable to enter the gap of the coupling portion of each of the hollow blades, thereby being capable of reducing noise.

Further, noise is reduced so that high-precision dimensional control of the gap of the coupling portion of each of the hollow blades is not required. Consequently, dimensional control at the time of manufacture is facilitated to thereby facilitate manufacture.

DESCRIPTION OF EMBODIMENTS

Figure 1:
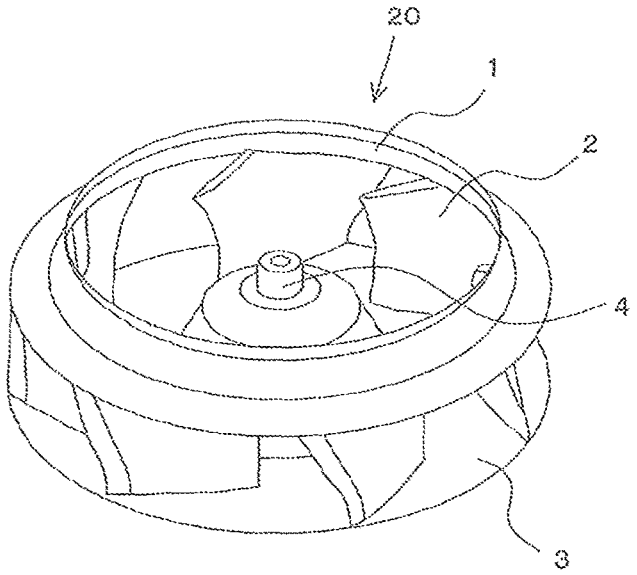
FIG. 1 is a perspective view for illustrating a turbofan according to Embodiment 1 of the present invention.

Embodiments of the present invention are described below referring to the drawings.

Note that, in the drawings, components denoted by the same reference signs correspond to the same or equivalent components and are common throughout the description herein.

In addition, the forms of the components described herein are merely examples, and the components are not limited to the description herein.

Embodiment 1

Figure 2:
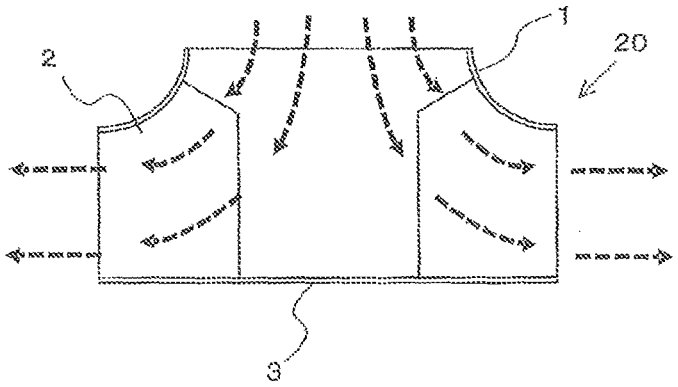
FIG. 2 is an explanatory view for illustrating the turbofan according to Embodiment 1 of the present invention.

FIG. 1 is a perspective view for illustrating a turbofan 20 according to Embodiment 1 of the present invention. FIG. 2 is an explanatory view for illustrating the turbofan 20 according to Embodiment 1 of the present invention.

As illustrated in FIG. 1 and FIG. 2, the turbofan 20 includes a shroud 1, blades 2 being hollow blades, and a main plate 3.

The shroud 1 has an annular shape, and is arranged to be opposed to the main plate 3. The main plate 3 has a circular shape, and is configured to be rotationally driven. A boss 4 defining a rotation axis is mounted to a center of the main plate 3.

The plurality of blades 2 are arranged between the shroud 1 and the main plate 3. Each of the blades 2 has a three-dimensionally twisted shape between the shroud 1 and the main plate 3.

Figure 3:
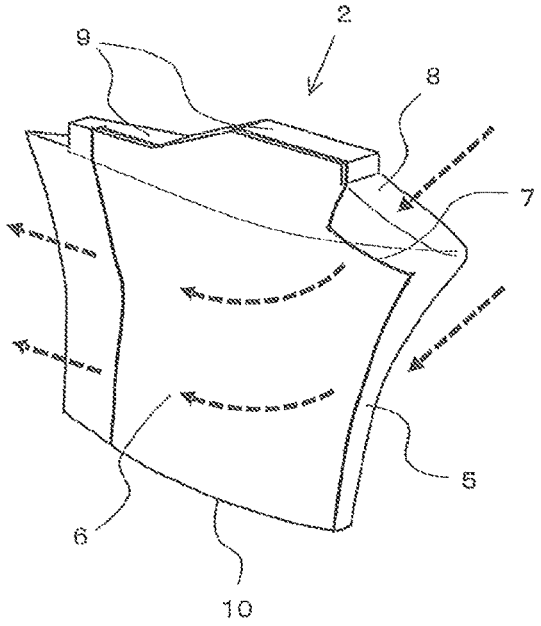
FIG. 3 is a perspective view for illustrating a blade of the turbofan according to Embodiment 1 of the present invention.
Figure 4:
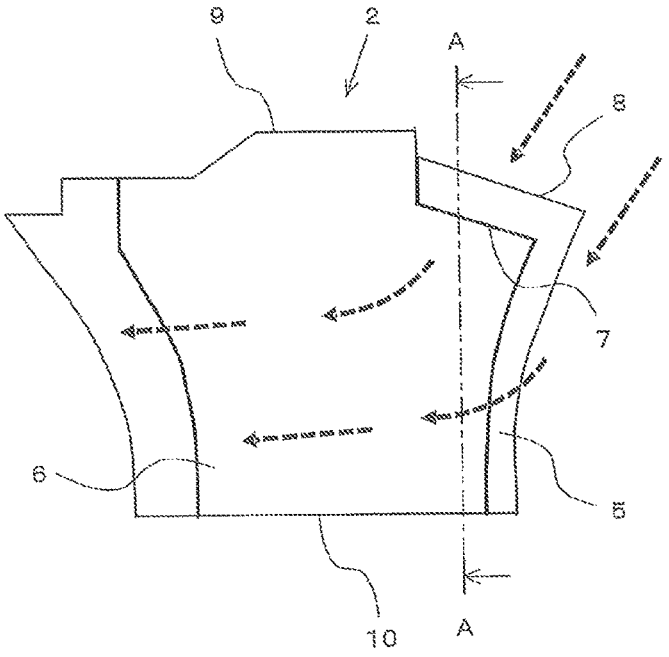
FIG. 4 is a side view for illustrating the blade of the turbofan according to Embodiment 1 of the present invention.
Figure 5:
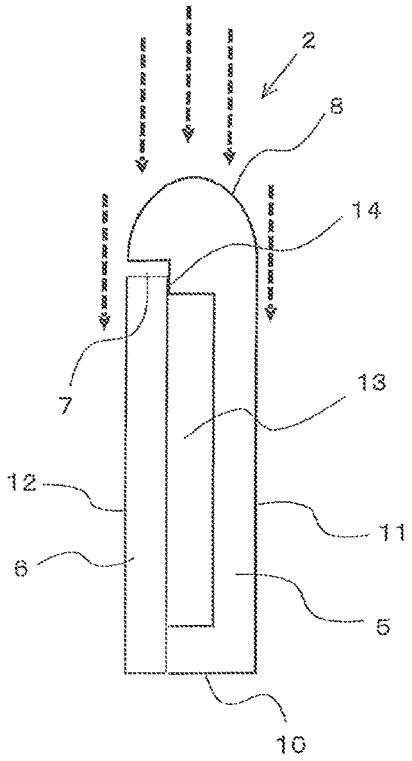
FIG. 5 is an explanatory cross-sectional view taken along the line A-A of FIG. 4, for illustrating the blade of the turbofan according to Embodiment 1 of the present invention.

FIG. 3 is a perspective view for illustrating the blade 2 of the turbofan 20 according to Embodiment 1 of the present invention. FIG. 4 is a side view for illustrating the blade 2 of the turbofan 20 according to Embodiment 1 of the present invention. FIG. 5 is an explanatory cross-sectional view taken along the line A-A of FIG. 4, for illustrating the blade 2 of the turbofan 20 according to Embodiment 1 of the present invention.

As illustrated in FIG. 3, each of the blades 2 of the turbofan 20 includes a blade main portion 5 and a blade cover 6. Each of the blades 2 is fixed to the shroud 1 at a joint surface 9, and is also fixed to the main plate 3 at a joint surface 10. A shroud-side leading edge portion 8 is formed next to the joint surface 9.

As illustrated in FIG. 5, the blade main portion 5 is arranged to be spaced apart from another blade main portion 5 in a circumferential direction of the main plate 3. The blade main portion 5 is a plate-like member constructing a suction surface 11 and a part of a pressure surface 12 of each blade 2. That is, the blade main portion 5 includes the suction surface 11 of the blade 2, the shroud-side leading edge portion 8 extending in a curve shape from the suction surface 11, and a part of the pressure surface 12 extending to the main plate 3 side and being behind the shroud-side leading edge portion 8.

Further, the blade cover 6 is a plate-like member mounted to the blade main portion 5 to construct a part of the pressure surface 12 of the blade 2.

The blade main portion 5 and the blade cover 6 are coupled to each other, thereby defining a hollow portion 13 inside the blade 2. That is, the blade cover 6 is mounted to the blade main portion 5, thereby defining the hollow portion 13 (hollow space) together with the blade main portion 5. A coupling portion 7 between the blade main portion 5 and the blade cover 6 is formed not in the shroud-side leading edge portion 8 of the blade 2, but in a surface region parallel to a direction of air flowing over the pressure surface 12 of the blade 2.

As illustrated in FIG. 3, the coupling portion 7 between the blade main portion 5 and the blade cover 6 is formed in a part of the pressure surface 12 along a direction orthogonal to the direction of the air. The part of the pressure surface 12 extends to the main plate 3 side and is behind the shroud-side leading edge portion 8. A part of the coupling portion 7 is bent to continuously extend from the pressure surface 12 to the joint surface 9. The coupling portion 7 is bent at both end portions thereof toward the main plate 3 side to extend toward the main plate 3 side across the pressure surface 12 to reach the main plate 3. The coupling portion 7 is also bent at both end portions thereof toward the joint surface 10 to continuously extend up to the joint surface 10.

That is, the coupling portion 7 between the blade main portion 5 and the blade cover 6 is not formed in the shroud-side leading edge portion 8 that directly receives air flowing from a direction of the rotation axis of the blades 2.

Further, similarly, the coupling portion 7 between the blade main portion 5 and the blade cover 6 is not formed in a bending edge portion being an interface between the pressure surface 12 and the suction surface 11 that directly receives the air flowing from the direction of the rotation axis of the blades 2.

As described above, the coupling portion 7 of each blade 2 is formed in the surface region parallel to the direction of the air flowing over the pressure surface 12 of the blade 2. Thus, the air sucked from the direction of the rotation axis of the turbofan 20 is less liable to enter a gap of the coupling portion 7. On the other hand, in the related-art blade including the coupling portion formed in the shroud-side leading edge portion, the air enters the gap of the coupling portion to disturb the flow of air flowing over a blade surface, with the result that noise is easily caused. In Embodiment 1, the air is less liable to enter the gap of the coupling portion 7. Thus, the flow of air flowing over the blade surface is not disturbed, thereby being capable of reducing noise.

Further, to prevent increase in noise, the related-art blade requires high-precision dimensional control of the gap of the coupling portion in the shroud-side leading edge portion. However, in this embodiment, noise can be reduced. Thus, control of the gap of the coupling portion 7 is not required. Consequently, dimensional control at the time of manufacture is facilitated to thereby facilitate manufacture.

Embodiment 2

Figure 6:
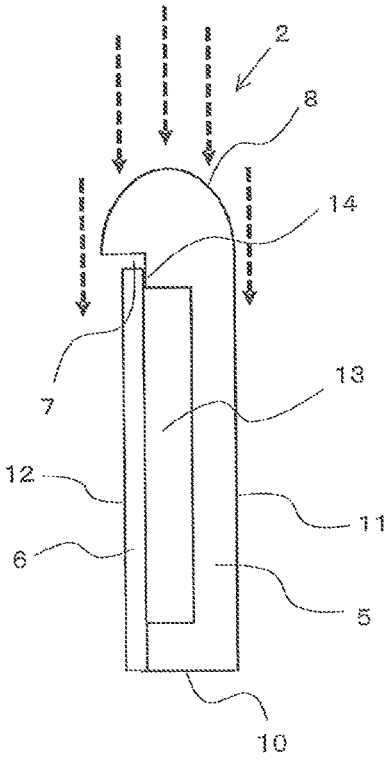
FIG. 6 is an explanatory view for illustrating a blade of a turbofan according to Embodiment 2 of the present invention.

FIG. 6 is an explanatory view for illustrating the blade 2 of the turbofan 20 according to Embodiment 2 of the present invention.

As illustrated in FIG. 6, in Embodiment 2, when the blade main portion 5 and the blade cover 6 are combined into the blade 2, the blade cover 6 is arranged on an inner side of the blade 2 with respect to the blade main portion 5. A joint surface 14 for joining the blade cover 6 to the blade main portion 5 is set on the inner side of the blade 2, and a part of the pressure surface 12 extending to the main plate 3 side and being behind the shroud-side leading edge portion 8 of the blade main portion 5 protrudes outward from the pressure surface 12 of the blade cover 6. The other configurations are the same as those of Embodiment 1.

Note that, in Embodiment 2, a positional relationship between the blade cover 6 and the blade main portion 5 is determined by the joint surface 14 formed at an end portion of the blade main portion 5 to be recessed to the inner side of the blade 2, but the present invention is not limited thereto. The positional relationship between the blade cover 6 and the blade main portion 5 may be restricted by, for example, a joint surface at a vicinity of a center of the blade cover 6, a boss pin, and a rib.

The turbofan 20 according to Embodiment 2 attains the same effect as that of Embodiment 1. In addition, the pressure surface 12 of the blade cover 6 parallel to the direction of the air is positioned on the inner side of the blade 2 with respect to the pressure surface 12 of the blade main portion 5. Thus, irrespective of assembly variations, the blade cover 6 is not positioned on an outer side of the blade main portion 5 so that the air does not enter the gap of the coupling portion 7. Further, the flow of air flowing along the pressure surface 12 is not disturbed because the air does not impinge against the blade cover 6. Consequently, noise can be reduced.

Embodiment 3

Figure 7:
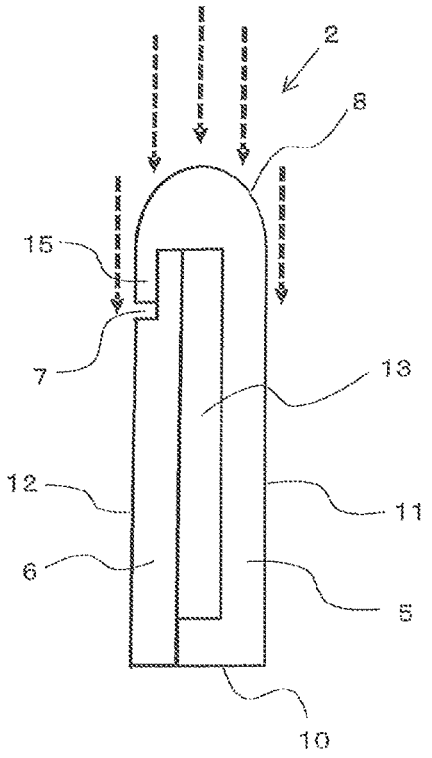
FIG. 7 is an explanatory view for illustrating a blade of a turbofan according to Embodiment 3 of the present invention.

FIG. 7 is an explanatory view for illustrating the blade 2 of the turbofan 20 according to Embodiment 3 of the present invention.

As illustrated in FIG. 7, in Embodiment 3, as a locking portion configured to prevent the blade cover 6 from being moved to the outer side of the blade main portion 5 by a centrifugal force, a protrusion 15 is formed on the blade main portion 5. The other configurations are the same as those of Embodiment 1.

The turbofan 20 according to Embodiment 3 attains the same effect as that of Embodiment 1. In addition, owing to the protrusion 15, the blade cover 6 is not moved to the outer side of the blade main portion 5 by the centrifugal force. Thus, the blade cover 6 is not positioned on the outer side of the blade main portion 5 so that the air does not enter the gap of the coupling portion 7. Further, the flow of air flowing along the pressure surface 12 is not disturbed because the air does not impinge against the blade cover 6. Consequently, noise can be reduced.

Note that, as the locking portion configured to prevent the blade cover 6 from being moved to the outer side of the blade main portion 5 by the centrifugal force, in addition to the protrusion 15, various members such as a locking piece and a locking plate may be used. Further, not only one locking portion but also a plurality of locking portions may be used. The locking portion may have a certain width.

Embodiment 4

Figure 8:
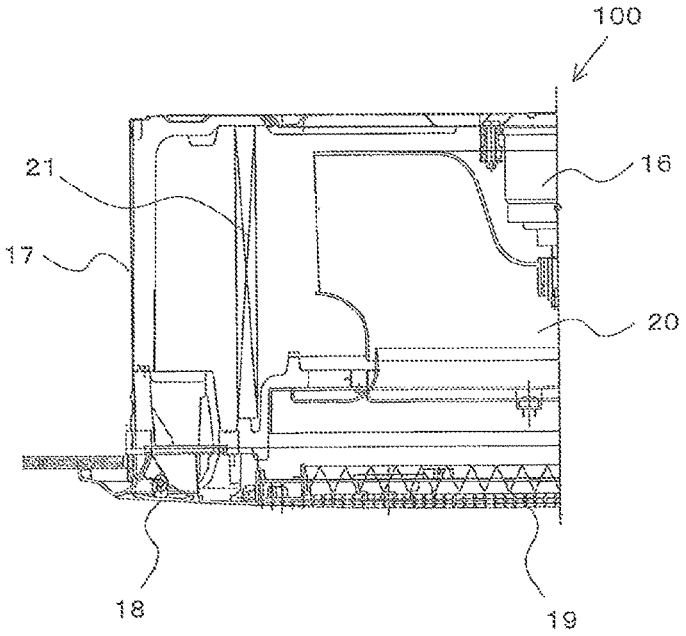
FIG. 8 is a schematic view for illustrating a ceiling embedded indoor unit of an air-conditioning apparatus according to Embodiment 4 of the present invention.

FIG. 8 is a schematic view for illustrating a ceiling embedded indoor unit 100 of an air-conditioning apparatus according to Embodiment 4 of the present invention. In FIG. 8, a left half of the ceiling embedded indoor unit 100 is illustrated.

The ceiling embedded indoor unit 100 is embedded and installed in a space above a ceiling, and a decorative panel 19 is mounted on an area covering from an opening portion of a lower surface of the ceiling embedded indoor unit 100 to a peripheral edge of an opening portion of the ceiling. A fan motor 16 is mounted to a top plate of a main body outer portion 17, and the turbofan 20 is fixed to an output shaft of the fan motor 16.

In the air-conditioning apparatus including the ceiling embedded indoor unit 100 described above, when operation is started, the fan motor 16 is rotationally driven, thereby rotating the turbofan 20 fixed to the fan motor 16. Along with the rotation of the turbofan 20, the air in a room is sucked into the ceiling embedded indoor unit 100 through a center portion of the decorative panel 19 to flow into the turbofan 20, and then is blown out in a centrifugal direction of the turbofan 20. The air flowing out of the turbofan 20 passes through a heat exchanger 21 to be conditioned into cool air or warm air in the heat exchanger 21, and then is blown out into the room through an air outlet 18.

In Embodiment 4, the turbofan 20 according to any one of Embodiment 1 to Embodiment 3 is used as the turbofan 20. Thus, without high-precision dimensional control of the gap of the coupling portion 7 of each of the blades 2 of the turbofan 20, the air-conditioning apparatus producing reduced noise can be provided.

Note that, the turbofan 20 according to Embodiment 1 to Embodiment 3 can be widely applied to and mounted in air-conditioning apparatus and various apparatus including an air-sending unit.

According to Embodiment 1 to Embodiment 4, the coupling portion 7 between the blade main portion 5 and the blade cover 6 is formed in the surface region (pressure surface 12) parallel to the direction of the air flowing over the pressure surface 12 of each blade 2. Thus, the air sucked from the direction of the rotation axis of the turbofan 20 is less liable to enter the gap of the coupling portion 7 of the blade 2, thereby being capable of reducing noise.

Further, noise is reduced so that high-precision dimensional control of the gap of the coupling portion 7 of the blade 2 is not required. Consequently, dimensional control at the time of manufacture is facilitated to thereby facilitate manufacture.

The coupling portion 7 between the blade main portion 5 and the blade cover 6 is formed in the surface region (pressure surface 12) parallel to the direction of the air flowing over the pressure surface 12 of the blade 2. The surface region extends to the main plate 3 side and is behind the shroud-side leading edge portion 8 of the blade main portion 5. Thus, the air sucked from the direction of the rotation axis of the turbofan 20 only impinges against the shroud-side leading edge portion 8 of the blade main portion 5, but is less liable to enter the gap of the coupling portion 7 of the blade 2, thereby being capable of reducing noise.

Further, noise is reduced so that high-precision dimensional control of the gap of the coupling portion 7 of the blade 2 is not required. Consequently, dimensional control at the time of manufacture is facilitated to thereby facilitate manufacture.

The blade cover 6 is arranged on the inner side of the blade 2 with respect to the blade main portion 5. Thus, irrespective of assembly variations, the blade cover 6 is not positioned on the outer side of the blade main portion 5 so that the air does not enter the gap of the coupling portion 7. Further, the flow of air flowing along the pressure surface 12 is not disturbed because the air does not impinge against the blade cover 6. Consequently, noise can be reduced.

The blade main portion 5 includes the protrusion 15 configured to prevent the blade cover 6 from being moved to the outer side of the blade main portion 5. With this configuration, the blade cover 6 is prevented by the protrusion 15 from being moved to the outer side of the blade main portion 5 by the centrifugal force. Thus, the blade cover 6 is not positioned on the outer side of the blade main portion 5 so that the air does not enter the gap of the coupling portion 7. Further, the flow of air flowing along the pressure surface 12 is not disturbed because the air does not impinge against the blade cover 6. Consequently, noise can be reduced.

The blade 2 forms a three-dimensional blade with a twisted shape between the shroud 1 and the main plate 3. With this configuration, it is possible to provide the turbofan 20 including hollow and lightweight three-dimensional blades each formed through construction of the blade 2 by the blade main portion 5 and the blade cover 6.

The ceiling embedded indoor unit 100 of the air-conditioning apparatus includes the turbofan 20, and the heat exchanger 21 configured to exchange heat with the air flowing out of the turbofan 20. With this structure, it is possible to provide the air-conditioning apparatus producing reduced noise and including the turbofan 20 that does not require high-precision dimensional control of the gap of the coupling portion 7 of each of the blades 2.

Note that, Embodiment 1 to Embodiment 4 may be combined or modified as appropriate.

REFERENCE SIGNS LIST

1 shroud 2 blade 3 main plate 4 boss 5 blade main portion 6 blade cover 7 coupling portion 8 shroud-side leading edge portion 9 joint surface 10 joint surface 11 suction surface 12 pressure surface 13 hollow portion 14 joint surface 15 protrusion 16 fan motor 17 main body outer portion 18 air outlet 19 decorative panel 20 turbofan 21 heat exchanger 100 ceiling embedded indoor unit

The invention claimed is:

1. A turbofan, comprising:

a main plate having a circular shape and being configured to be rotationally driven;

a shroud having an annular shape and being arranged to be opposed to the main plate; and a plurality of hollow blades arranged between the main plate and the shroud, each of the plurality of hollow blades including:

a blade main portion arranged to be spaced apart from another blade main portion in a circumferential direction of the main plate, the blade main portion is partially covered by the shroud, the blade main portion includes a leading edge portion of the blade main portion that is uncovered by the shroud and that faces the shroud of the blade main portion, a blade cover mounted to the blade main portion to define a hollow space between the blade main portion and the blade cover, and a coupling portion between the blade main portion and the blade cover being formed in a surface region parallel to a direction of air flowing over a pressure surface of each of the plurality of hollow blades, the coupling portion extending to a side of the main plate and being behind the leading edge portion of the blade main portion that faces the shroud.

2. The turbofan of claim 1, wherein the blade cover is arranged on an inner side of each of the plurality of hollow blades with respect to the blade main portion.

3. The turbofan of claim 1, wherein the blade main portion includes a locking portion configured to prevent the blade cover from being moved to an outer side of the blade main portion.

4. The turbofan of claim 1, wherein the plurality of hollow blades arranged between the shroud and the main plate each being a three-dimensional blade having a twisted shape.

5. An air-conditioning apparatus, comprising:

a turbofan, including:

a main plate having a circular shape and being configured to be rotationally driven;

a shroud having an annular shape and being arranged to be opposed to the main plate; and a plurality of hollow blades arranged between the main plate and the shroud, each of the plurality of hollow blades including:

a blade main portion arranged to be spaced apart from another blade main portion in a circumferential direction of the main plate, the blade main portion is partially covered by the shroud, the blade main portion includes a leading edge portion of the blade main portion that is uncovered by the shroud and that faces the shroud of the blade main portion, a blade cover mounted to the blade main portion to define a hollow space between the blade main portion and the blade cover, and a coupling portion between the blade main portion and the blade cover being formed in a surface region parallel to a direction of air flowing over a pressure surface of each of the plurality of hollow blades, the coupling portion extending to a side of the main plate and being behind the leading edge portion of the blade main portion that faces the shroud; and a heat exchanger configured to exchange heat with air flowing out of the turbofan.

* * * * *